United States Patent [19]

Osika et al.

[11] Patent Number: 5,041,706

[45] Date of Patent: Aug. 20, 1991

[54] SAFETY SWITCH WITH POSITIVE MOUNTING RETENTION AND PROLONGED OPENING CHARACTERISTICS

[75] Inventors: Thomas F. Osika, Valparaiso; John A. Stuhlmacher, Crown Point, both of Ind.

[73] Assignee: McGill Manufacturing Company, Inc., Valpariaso, Ind.

[21] Appl. No.: 514,858

[22] Filed: Apr. 26, 1990

[51] Int. Cl.[5] ..... H01H 3/20; H01H 27/00

[52] U.S. Cl. ..... 200/296; 200/295; 200/339; 200/321; 200/43.016; 200/433; 200/43.16

[58] Field of Search ..... 200/295, 296, 379, 321, 200/322, 43.11, 43.16, 43.17, 431, 433, 437, 438, 439, 275

[56] References Cited

U.S. PATENT DOCUMENTS

| | | | |
|---|---|---|---|
| 1,892,542 | 12/1932 | Stearns | 200/433 |
| 3,158,704 | 11/1964 | Sorenson | 200/433 |
| 4,170,725 | 10/1979 | Farrell | 200/433 |
| 4,314,121 | 2/1982 | Gabor | 200/339 X |
| 4,777,333 | 10/1988 | Valenzona | 200/339 X |
| 4,778,965 | 10/1988 | Valenzona | 200/296 |
| 4,870,230 | 9/1989 | Osika et al. | 200/339 X |
| 4,947,009 | 8/1990 | Osika et al. | 200/43.16 |

FOREIGN PATENT DOCUMENTS

| | | | |
|---|---|---|---|
| 3127611 | 1/1983 | Fed. Rep. of Germany | 200/295 |
| 2058461 | 4/1981 | United Kingdom | 200/295 |

*Primary Examiner*—Ernest G. Cusick

*Attorney, Agent, or Firm*—Leydig, Voit, Mayer

[57] ABSTRACT

An electrical switch includes a rocker-type actuator adapted to be pivoted between first and second positions within a housing in order to close and open switch contacts. The actuator slidably supports a latch which normally engages the housing to prevent the actuator from being pivoted to its switch-closed position. By pulling on the latch and then lifting on the actuator, the actuator may be pivoted to its switch-closed position; the two-step operation protecting against accidental actuation of the switch. The switch housing is mounted with a snap fit in an opening iun a panel. A lug on the housing engages the underside of the panel to prevent the switch from being pulled out of the opening in the event a heavy lifting force is applied to the actuator without first releasing the latch. One switch contact is adapted to pivot and slide on a fulcrum which is laterally offset from the pivot axis of the actuator in order to delay opening of the switch relative to the position of the actuator.

7 Claims, 3 Drawing Sheets

SAFETY SWITCH WITH POSITIVE MOUNTING RETENTION AND PROLONGED OPENING CHARACTERISTICS

BACKGROUND OF THE INVENTION

This invention relates generally to a switch and, more particularly, to a switch of the type having a pivotally mounted rocker actuator. When the rocker is pivoted between first and second positions, it changes the state of the switch contacts. A switch of this general type is disclosed in commonly assigned copending United States application Ser. No. 402,907, filed Sept. 1, 1989, and entitled Safety Rocker with Improved Actuator Mounting.

With certain types of equipment such as power tools, power take-off attachments for tractors, and other equipment which might possibly cause injury, it is desirable to protect the switch against accidental actuation. The copending application identified above discloses a rocker switch which is of comparatively simple and low cost construction and which effectively guards against accidental actuation in that the switch can be thrown to an actuated condition only if two separate and distinct motions are applied to the switch. Specifically, the switch includes a hollow body having a switch contact, a switch actuator which is supported by the body to pivot between first and second positions to change the state of the switch contact, and a latch which is supported both to pivot with the actuator and to slide relative to the actuator. Only by first sliding the latch relative to the actuator and to an unlatched position can the actuator be pivoted relative to the body to change the state of the switch contact to an actuated condition.

The body of the switch disclosed in the copending application is installed with a snap fit in a hole in a mounting panel. In some instances, attempts are made to pivot the actuator toward its actuated position without first releasing the latch. When this occurs, significant forces are exerted on the switch body and tend to pull the body out of the hole in the mounting panel.

When the actuator is pivoted between its normal and actuated positions, it causes a slider to slide across and pivot on a fulcrum to close and open the switch contact. In some installations, it is desirable to prolong opening of the switch contact until the actuator has pivoted a predetermined distance toward its normal position.

SUMMARY OF THE INVENTION

One of the aims of the present invention is to provide a new and improved safety switch of the foregoing type which, while being capable of being installed with a snap fit in a hole in a mounting panel, is more positively retained in the hole in order to reduce the danger of the switch being pulled out of the hole if an attempt is made to pivot the switch actuator without first unlatching the actuator.

Another object of the invention is to provide a switch in which the switch contact, the fulcrum of the slider and the pivot axis of the actuator are uniquely positioned relative to one another to cause the slider to remain in engagement with the contact for a longer period of time following movement of the actuator toward its normal position.

These and other objects and advantages of the invention will become more apparent from the following detailed description when taken in conjunction with the accompanying drawings.

DETAILED DESCRIPTION OF THE PREFERRED EMBODIMENT

Figure 1:
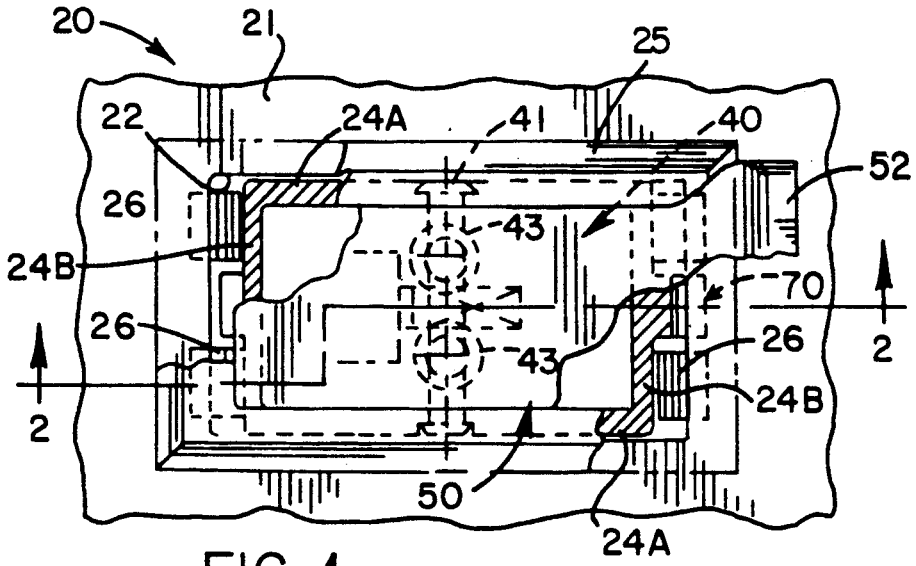
FIG. 1 is a top plan view of a new and improved safety switch incorporating the unique features of the present invention and shows the switch installed in a typical mounting panel.

For purposes of illustration, the present invention has been shown in the drawings as being incorporated in an electrical switch 20 for making or breaking circuits to one or more electrical utilization devices (not shown). By way of example, one utilization device may be a solenoid which, when energized, causes the power take-off of a tractor to engage. The switch may be used solely with the solenoid or may be used both with the solenoid and with another electrical utilization device whose operation is interrupted when the solenoid is energized.

In the present instance, the switch 20 has been shown in conjunction with a mounting panel or plate 21 which is formed with a rectangular opening 22 for receiving the switch. The switch includes a main body or housing 23 (FIG. 2) which is partially defined by a molded plastic sleeve 24 of rectangular cross-section telescoped into the opening 22 and formed with a peripheral flange 25 which engages the upper side of the plate 21 around the margins of the opening to prevent the sleeve from moving inwardly through the opening. The sleeve includes two laterally spaced and opposing side walls 24A and two depending end walls 24B located at the ends of and extending perpendicular to the side walls (see FIG. 3). Two laterally spaced and cantilevered fingers 26 are molded integrally with and are hinged to the lower end portion of each end wall 24B and are adapted to pass through the opening 22 during insertion of the sleeve into the opening. Just after such insertion, the fingers 26 spring outwardly and engage the lower portion of the edge of the opening 22 so as to hold the sleeve 24 releasably in the opening.

The housing 23 also includes an upwardly opening cup 27 (FIG. 2) made of plastic and adapted to be telescoped into the lower end portion of the sleeve 24, the upper edge of the cup engaging a radially inwardly projecting flange 28 formed integrally with the sleeve about midway along the height of the sleeve. Lips 29 on the lower ends of the end walls 24B engage the cup with a snap fit in order to hold the sleeve and the cup in assembled relation.

Figure 2:
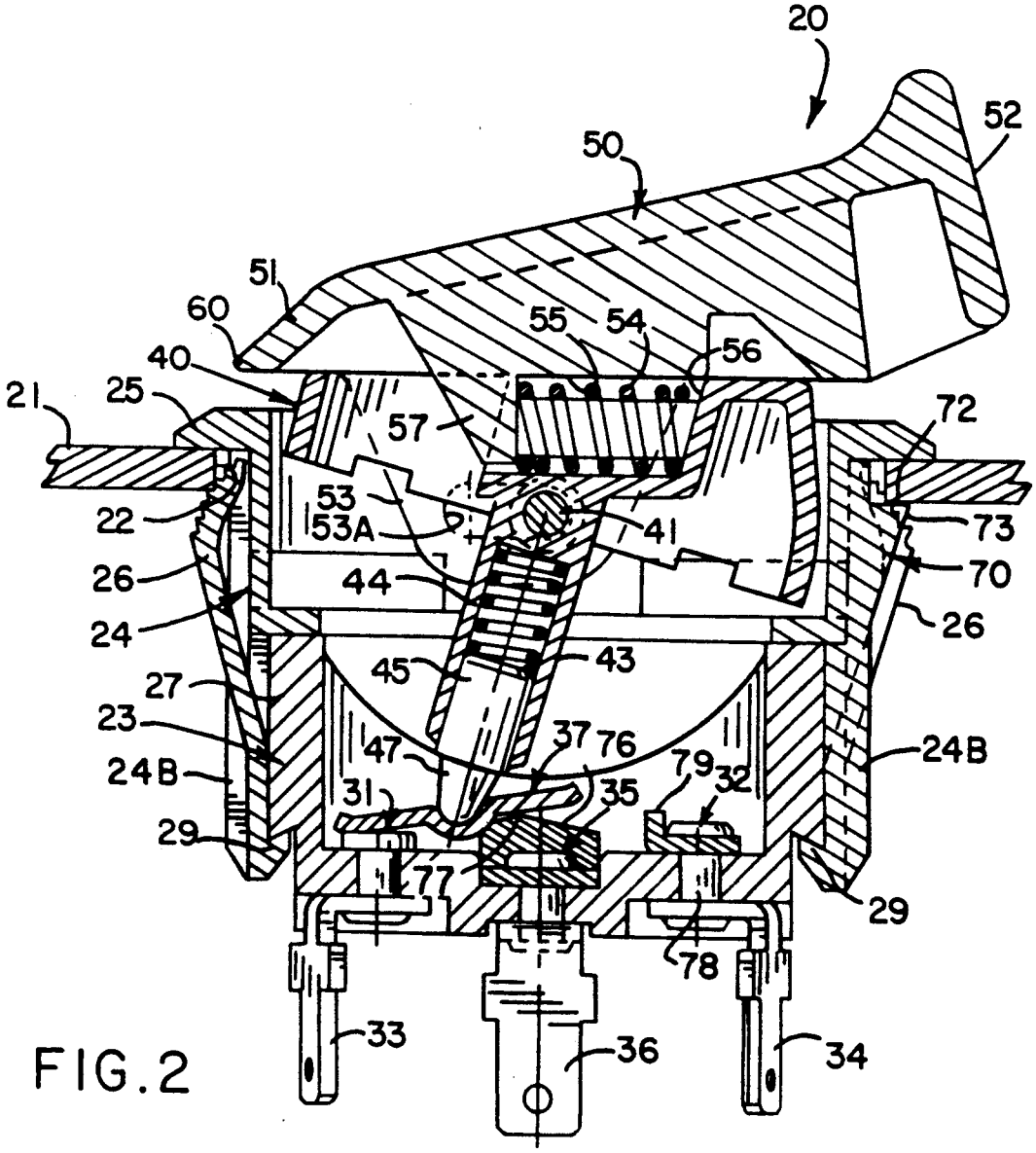
FIG. 2 is an enlarged fragmentary cross-section taken substantially along the line 2—2 of FIG. 1.
Figure 3:
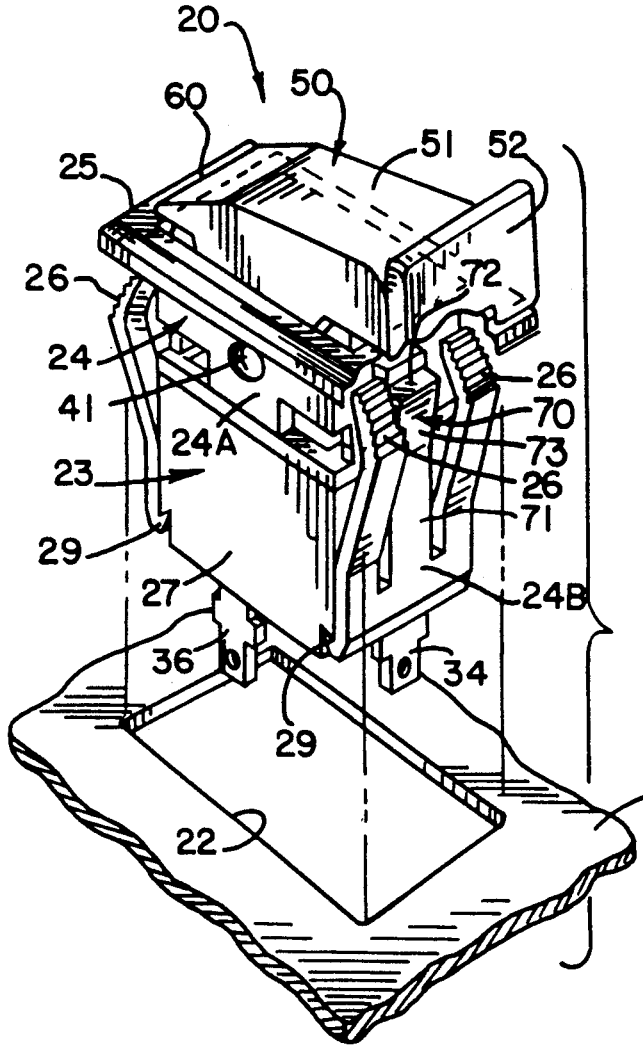
FIG. 3 is an exploded perspective view of the switch and the mounting panel.

Located in the bottom of the cup 27 are two side-by-side sets of spaced electrical contacts 31 and 32 (FIGS. 2 and 6) connected to terminals 33 and 34, respectively. Positioned between the contacts 31 and 32 of each set is a fulcrum 35 connected to a terminal 36. Advantageously, a switch contact 37 in the form of a metal strip is supported both to rock on and slide across each fulcrum. Normally, each slider contact 37 is positioned as shown in FIG. 2 in which the slider is rocked downwardly in one direction about the fulcrum 35 and bridges the fulcrum and the contact 31 to complete a circuit between the terminals 33 and 36 and energize a utilization device in the circuit. Upon being moved to the right, the slider bridges the fulcrum 35 and the contact 32 (see FIG. 5) so as to complete a different circuit and energize another utilization device such as the solenoid of a power take-off.

Figure 5:
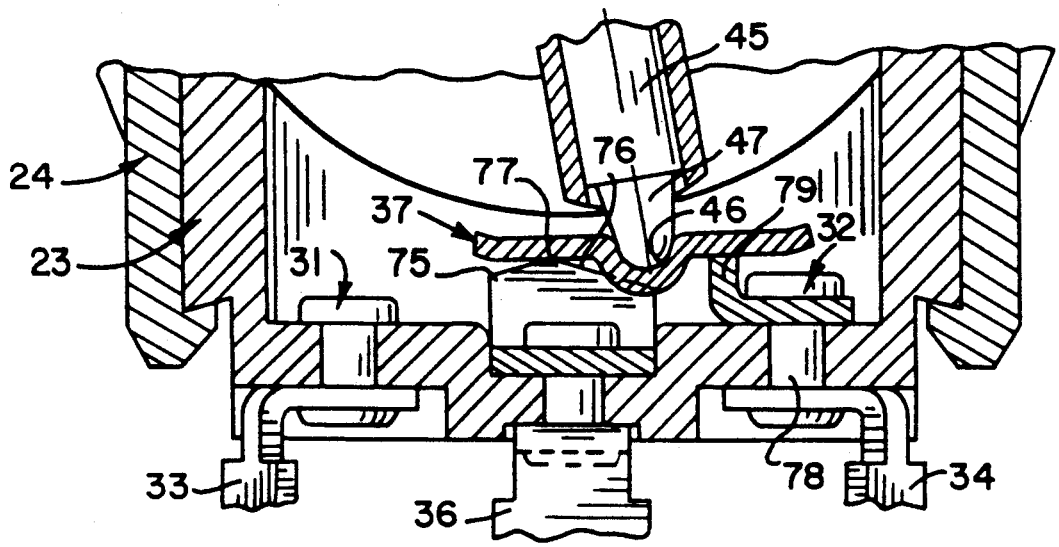
Figure 6:
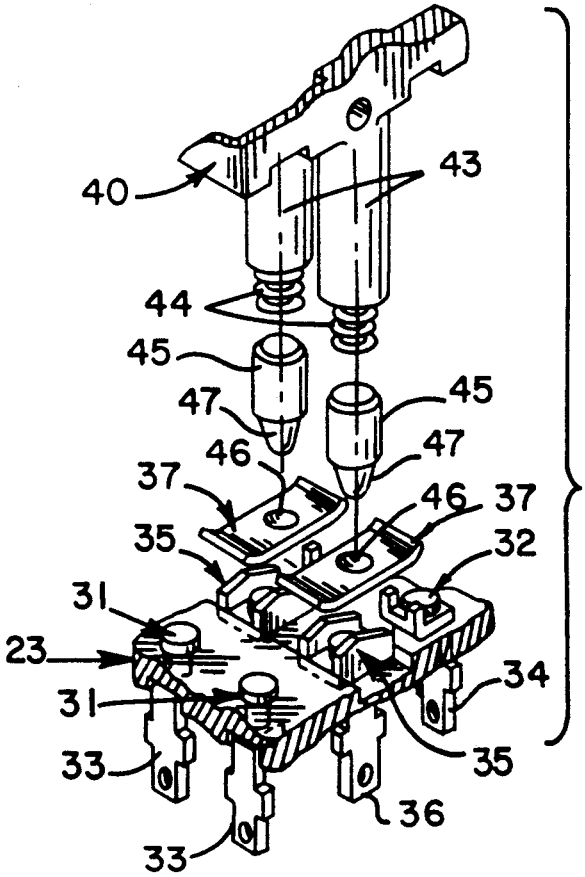
FIG. 6 is an exploded perspective view of certain components of the switch.

Sliding and pivoting of the slider contacts 37 is effected by a rocker-type actuator 40 which is supported by a rivet 41 to pivot counterclockwise from a normal position (FIG. 2) to an actuated position (FIG. 5). The rivet is fixed to and extends laterally of the sleeve 24 of the housing 23.

Herein, the rocker 40 is molded of plastic and is formed with a pair of side-by-side and generally vertical sleeves 43 (FIGS. 2 and 6) which house springs 44 and plungers 45, the springs biasing the plungers downwardly against the slider contacts 37. The upper side of each slider contact 37 is formed with a hemispherical socket 46 (FIG. 6) which receives a rounded tip 47 of the plunger in order to enable the plunger to pivot relative to the contact.

Figure 4:
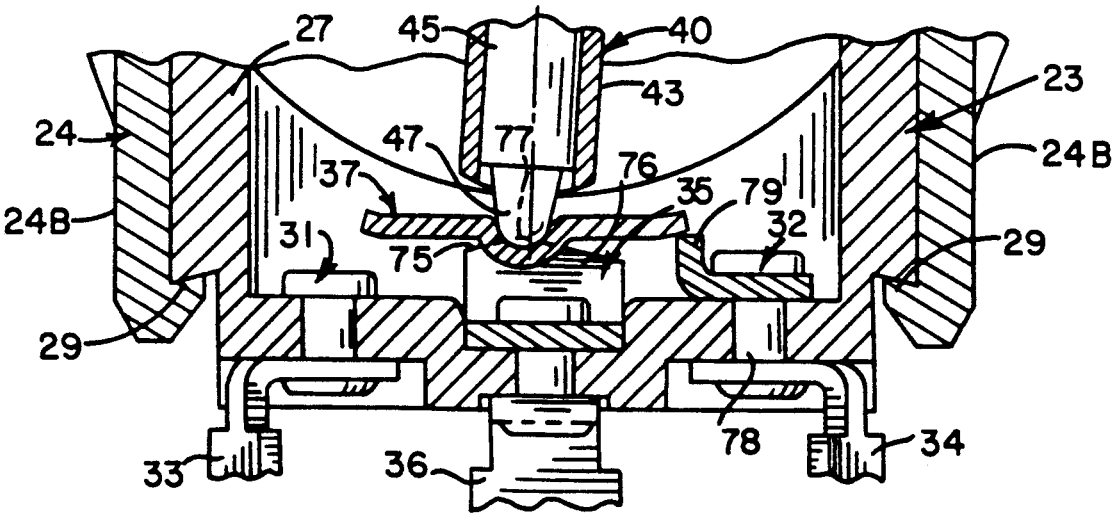
FIGS. 4 and 5 are enlarged fragmentary views similar to FIG. 2 but show certain components of the switch in successively moved positions.

According to one feature of the invention, each of the fulcrums 35 is positioned so as to prolong engagement of the slider 37 with the contact 32 when the rocker 40 is pivoted clockwise from the actuated position shown in FIG. 5 toward the normal position shown in FIG. 2. As shown in FIGS. 4 and 5, each fulcrum is generally V-shaped and is defined in part by two mutually inclined surfaces or edges 75 and 76 which meet at an apex 77. Conventionally, the apex 77 is located in the same vertical plane as the pivot axis 41 of the rocker 40 and is centered between the contacts 31 and 32.

In carrying out the invention, the apex 77 of each fulcrum 35 is offset laterally from the pivot axis 41 of the rocker 40 and is located nearer to the contact 31 than to the contact 32. Moreover, the contact 32 is defined by a rivet 78 and by a generally L-shaped tab 79, the upper end of the tab lying generally in the same horizontal plane as the apex 77.

When the rocker 40 is in its normal position shown in FIG. 2, the springs 44 act through the plungers 45 to bias the slider contacts 37 to a position in which such contacts are pivoted counterclockwise about the fulcrums 35 and engage the contacts 31. The springs also act through the plungers and the slider contacts to bias the rocker clockwise toward its normal position. When the rocker 40 is pivoted counterclockwise from the normal position shown in FIG. 2, each plunger 45 first acts through the socket 46 of the slider contact 37 to cause the slider contact to slide from left-to-right across the edge 75 of the fulcrum 35. As the plunger reaches the apex 77, it causes the slider contact to pivot clockwise to a generally horizontal position shown in FIG. 4, the right end of the slider contact engaging the upper end of the tab 79 of the contact 32. With further counterclockwise pivoting of the plunger, the slider contact 37 slides on the apex 77 and the tab 79 to the far right position shown in FIG. 5. As the plunger passes the apex 77 of the fulcrum 35, it crosses over center and thereafter urges the rocker 40 in a counterclockwise direction.

When each plunger 45 is rocked in the opposite direction from the position shown in FIG. 5 toward that shown in FIG. 2, the slider contact 37 slides reversely from the position shown in FIG. 5 to the position shown in FIG. 4 and then pivots counterclockwise from the position shown in FIG. 4 to the position shown in FIG. 2. As the plunger moves past the apex 77 of the fulcrum 35, it again crosses over center so as to cause the spring 44 to snap the rocker 40 to its normal position. Because of the laterally offset relation between the pivot axis 41 of the rocker 40 and the apex 77 of the fulcrum 35, return of the rocker to its normal position and opening of the contact 32 are prolonged and are delayed relative to a case where the apex 77 is centered between the contacts 31 and 32.

The switch 20 is provided with a latch 50 which prevents the switch rocker 40 from being moved to its actuated position of FIG. 5 unless two separate and distinct motions are applied to the switch. The latch, however, enables the rocker to be returned from the position of FIG. 5 with a simple single motion. Thus, the switch 20 is truly a safety switch in that separate motions are required for actuation so as to prevent accidental actuation of the switch and yet, at the same time, the switch may be quickly de-actuated under an emergency condition.

More specifically, the latch 50 includes an elongated plate 51 (FIGS. 2 and 3) molded of plastic and formed with a somewhat enlarged gripping portion or handle 52 at its right end. The handle is gripped both to release the latch and to pivot the rocker 40.

Formed integrally with and depending from the plate 51 of the latch 50 are two laterally spaced ears 53 (FIG. 2) which straddle the rocker 40 and which fit into the sleeve 24 adjacent the side walls 24A thereof. The ears 53 are formed with elongated slots 53A which support the latch 50 for back and forth sliding on the rivet 41 between a latched position (FIG. 2) and an unlatched position. The latch is urged toward its latched position. For this purpose, a coil spring 54 (FIG. 2) is retained in the stem portion of a T-shaped slot 55 in the rocker 40 and is compressed between a wall 56 of the slot and a lug 57 which extends downwardly from the lower side of the plate 51 of the latch 50. The lug fits in the cross portion of the T-slot 55.

As shown in FIG. 2, a nose 60 on the end of the latch plate 51 overlies the upper end of the sleeve 24 when the rocker 40 is in its normal position and the latch 50 is in its latched position. If the handle 52 of the latch is lifted while the latch is latched, the nose 60 engages the sleeve and prevents the rocker from pivoting counterclockwise through a sufficient distance to move the slider contacts 37 into engagement with the contacts 32. Accordingly, the latch prevents the rocker from being accidentally pivoted to its actuated position. By pulling on the handle 52 and sliding the latch 50 along the rocker 40, the nose 60 is retracted to a position clearing the upper end of the sleeve 24 and permitting the rocker to pivot counterclockwise through a distance sufficient to effect closing of the contacts 37 and 32. Counterclockwise pivoting of the rocker may be effected by lifting upwardly on the handle 52. Thus, two distinct motions are required to pivot the rocker to its actuated position.

As the rocker 40 is pivoted to its actuated position, the nose 60 of the latch 50 moves into the sleeve 24 and rides along the inner side thereof. When the latch 50 is released from between the thumb and forefinger, the spring 54 presses the nose 60 of the latch into frictional engagement with the inner side of the sleeve 24 to help hold the rocker 40 in a stable switch-actuated position.

To de-actuate the switch 20, it is necessary only to push or slam the handle 52 of the latch 50 downwardly in order to pivot the rocker 40 in a clockwise direction. As an incident thereto, the nose 60 of the latch rides upwardly out of the sleeve 24 and clears the sleeve so as to enable the spring 54 to return the latch to its latched position with the nose again overlying the upper end of the sleeve 24 and again limiting counterclockwise pivoting of the rocker. Thus, the switch may be de-actuated with a single motion and may be de-actuated rapidly in an emergency situation.

On occasion, an inexperienced operator will attempt to actuate the switch without first sliding the latch 50 to its unlatched position. Instead, the operator will simply lift upwardly on the handle 52 and, when frustrated by his or her inability to actuate the switch, may apply a considerable lifting force to the handle. Indeed, the operator may apply such a heavy lifting force as to overcome the holding force of the fingers 26 and pull the entire switch out of the opening 22 in the panel 21.

In accordance with another aspect of the invention, means are provided for positively retaining the switch 20 in the panel 21 and for reducing the danger of the switch being pulled upwardly out of the opening 22 by a heavy lifting force applied to the handle 52. To this end, retaining means in the form of a lug 70 (FIGS. 1 to 3) formed on the outboard side of the right-hand end wall 24B adjacent the upper end thereof and beneath the lifting handle 52. As shown most clearly in FIG. 3, the lug is located at the upper end of a narrow strip 71 which forms part of the right end wall 24B and which is located between the two fingers 26 of that end wall. The lug is generally triangular in shape and its upper end defines a horizontal and upwardly facing shoulder 72 which underlies and is adapted to engage the lower side of the panel 21 to lock the housing 23 in the panel. The outboard side of the lug 70 slopes inwardly upon progressing downwardly and defines an inclined cam surface 73 which facilitates slipping the lug downwardly past the edge of the opening 22 when the housing 23 is inserted into the opening.

The spacing between the left end wall 24B and the right end of the shoulder 72 of the lug 70 is just slightly less than the spacing between the left and right edges of the opening 22. This allows the lug to clear the opening when the housing 23 is inserted into the opening. After insertion, the housing is shifted to the right to locate the shoulder 72 beneath the panel 21, and the fingers 26 of the left end wall 24B tend to bias the housing to the right to keep the shoulder beneath the panel. Thus, the shoulder is effective to keep the switch 20 from being pulled out of the opening 22 by a heavy lifting force applied to the handle 52.

We claim:

1. A safety switch adapted to be located in a generally rectangular opening formed through a mounting panel having inner and outer sides, said switch comprising a hollow body of generally rectangular cross-section and sized to fit in said opening, said body having a pair of laterally spaced side walls and having first and second end walls extending between and generally perpendicular to said side walls, said walls having outer ends, a peripheral flange on the other ends of said walls and engageable with the outer side of said panel to prevent said body from moving inwardly through said opening, resilient finger means on said body and engageable with the inner sides of said panel to releasably hold said body against moving outwardly through said opening, a switch contact in said body, a switch actuator, means mounting said switch actuator within said body for pivoting about a predetermined axis between first and second positions relative to said body to change the state of said switch contact, said axis extending generally perpendicular to said side walls, said actuator having a handle portion located adjacent said first end wall and adapted to be forced outwardly to pivot said actuator from said first position to said second position, means for selectively latching said actuator against movement from said first position to said second position, and retaining means on said first end wall and engageable with the inner side of said panel independently of said fingers to prevent said body from being pulled out of said opening if said handle is forced outwardly when said actuator is latched against movement from said first position to said second position.

2. A safety switch as defined in claim 1 in which said retaining means comprise a lug projecting from an outboard side of said first end wall adjacent the outer end thereof and an outwardly facing shoulder which is engage the inner side of said panel.

3. A safety switch as defined in claim 2 in which said lug includes an outboard surface located inwardly of said shoulder and inclined in such a direction as to cam against the edge of said opening and facilitate inward insertion of said lug through said opening.

4. A safety switch as defined in claim 2 in which said finger means comprise two resiliently flexible and cantilevered fingers extending outwardly from said first end wall and spaced laterally from one another across said first end wall, said first end wall including a relatively narrow strip located between said fingers, said lug being located on the outer end portion of said strip.

5. A switch comprising a body having a switch contact, a switch actuator mounted within said body to pivot about a predetermined axis between first and second positions to change the state of said switch contact, said actuator comprising a rocker and further comprising a spring-loaded plunger projecting from said rocker, a slider associated with said plunger and adapted to be moved into and out of engagement with said contact by said plunger in response to said actuator being pivoted back and forth between said first and second positions, respectively, a fulcrum in said body and slidably and pivotally supporting said slider for movement into and out of engagement with said contact, said fulcrum having two mutually inclined surfaces which meet at an apex about which said slider pivots, said contact being offset laterally from one side of said axis, and said apex of said fulcrum being offset laterally from the other side of said axis.

6. A switch as defined in claim 5 in which the apex of said fulcrum and a portion of said contact lie substantially in a common plane extending parallel to said axis.

7. A safety switch adapted to be located in a generally rectangular opening formed through a mounting panel having inner and outer sides, said switch comprising a hollow body of generally rectangular cross-section and sized to fit in said opening, said body having a pair of laterally spaced side walls and having first and second end walls extending between and generally perpendicular to said side walls, said walls having outer ends, a peripheral flange on the outer ends of said walls and engageable with the outer side of said panel to prevent said body from moving inwardly through said opening, resilient finger means on said body and engageable with the inner side of said panel to releasably hold said body against moving outwardly through said opening, a switch contact in said body, a switch actuator, means mounting said switch actuator within said body for pivoting about a predetermined pivot axis between first and second positions relative to said body to change the state of said switch contact, said axis extending generally perpendicular to said side walls, said actuator comprising a rocker and further comprising a spring-loaded plunger projecting from said rocker, a slider associated with said plunger and adapted to be moved into and out of engagement with said contact by said plunger in response to said actuator being pivoted back and forth between said first and second positions, respectively, a fulcrum in said body and slidably and pivotally supporting said slider for movement into and out of engagement with said contact, said fulcrum having two mutually inclined surfaces which meet at an apex about which said slider pivots, said contact being offset laterally from one side of said pivot axis, said apex of said fulcrum being offset laterally from the other side of said pivot axis, said actuator having a handle portion located adjacent said first end wall and adapted to be forced outwardly to pivot said actuator from said first position to said second position, means for selectively latching said actuator against movement from said first position to said second position, and retaining means on said first end wall and engageable with the inner side of said panel independently of said fingers to prevent said body from being pulled out of said opening if said handle is forced outwardly when said actuator is latched against movement from said first position to said second position.

* * * * *